US005087036A

United States Patent [19]

Cooper

[11] Patent Number: 5,087,036

[45] Date of Patent: Feb. 11, 1992

[54] EXERCISE DEVICE AND METHOD FOR FOOT MUSCLE STRETCHING

[76] Inventor: James H. Cooper, 2057 Zelda Dr., N.E., Atlanta, Ga. 30345

[21] Appl. No.: 500,766

[22] Filed: Jun. 28, 1990

[51] Int. Cl.[5] ..... A63B 23/04

[52] U.S. Cl. ..... 272/96; 272/DIG. 4; 272/903; 128/25 B

[58] Field of Search ..... 272/93, 94, 96, 105, 272/116, 903, DIG. 4; 128/25 R, 25 B

[56] References Cited

U.S. PATENT DOCUMENTS 3,292,320 1/1967 Benedetto .
3,401,931 9/1968 McCafferty et al. .
3,746,335 7/1973 Fichter et al. .
4,371,160 2/1983 Shooltz ..... 272/96
4,422,635 12/1983 Herod et al. ..... 272/96
4,561,649 12/1985 Forsythe ..... 272/96
4,573,678 3/1986 Lamb et al. ..... 272/96
4,577,861 3/1986 Bangerter et al. ..... 272/96
4,693,470 9/1987 Ogawa ..... 272/96
4,862,875 9/1989 Heaton ..... 128/25 R X
4,936,300 6/1990 Funatogawa ..... 272/96 X

*Primary Examiner*—Richard J. Apley
*Assistant Examiner*—Joe H. Cheng
*Attorney, Agent, or Firm*—Jones, Askew & Lunsford

[57] ABSTRACT

A foot and leg stretching device wherein the heel, ball and arch of the foot remain flat on a foot plate while the toes are inclined upwardly against a selectively positionable plate. The device is designed to simultaneously stretch the Achilles tendon cord, arch of the foot and calf muscles.

7 Claims, 2 Drawing Sheets

EXERCISE DEVICE AND METHOD FOR FOOT MUSCLE STRETCHING

TECHNICAL FIELD

The present invention relates in general to athletic exercise apparatus, and relates in particular to a stretching device designed to simultaneously stretch the Achilles tendon cord, arch of the foot and calf muscles.

BACKGROUND OF THE INVENTION

Doctors and physical therapists advise thoroughly stretching the muscles and tendons of one's body before engaging in any physical activity. Stretching the muscles and tendons increases flexibility and prevents muscle cramps and damage to muscles or tendons.

In strenuous athletic activities, such as marathon running, muscle and tendon flexibility are most important. The muscles, tendons and joints in a runner's legs must be flexible and well-stretched before beginning a long run. Failure to properly stretch the leg muscles and tendons may result in temporary and permanent injuries. Failure to adequately stretch the Achilles tendon cord and calf muscles may result in a condition called plantar fasciitis, which is the inflammation of the plantar fascia or arch of the foot. Often it is difficult to simultaneously stretch the Achilles tendon cord and calf muscles in order to maintain adequate flexibility in the arch of the foot. Thus, there is a need for a device that helps athletes, particularly runners, simultaneously stretch the Achilles tendon cord and calf muscles in order to keep the arch of the foot and leg flexible.

Previous devices have been designed to improve flexibility in the foot and leg but none address the problem associated with flexing the arch of the foot. In addition, existing prior art fails to provide for a device that allows the Achilles tendon cord, arch of the foot and calf muscles to stretch simultaneously.

Shooltz, U.S. Pat. No. 4,371,160, discloses an exercise device for runners. The device comprises a base member and pivoting pads that are designed to receive and secure human feet. With the feet secured on the pads, the pads pivot away from the base of the exercise device against an adjustable resistance element. The device is designed to exercise the anterior leg muscles while keeping the posterior muscles inactive.

Herod et al., U.S. Pat. No. 4,422,635, discloses a portable multiple use exerciser. The device has a base and a pair of side-by-side elongated levers pivotally supported at one end of the base for independent oscillation relative to the base. The device is designed to exercise body extremities and increase blood circulation.

Forsythe, U.S. Pat. No. 4,561,649, discloses an adjustable foot rest having an optional exercise feature. The device comprises several flat members capable of being folded into a foot rest or a device that exercises the feet and legs. When the feet are exercised they remain flat against one of the flat members of the device. The device is also capable of being unfolded and stored in a compact, flat manner.

Ogawa, U.S. Pat. No. 4,693,470, discloses an auxiliary instrument for stretching and softening exercises. The instrument is provided for stretching exercises of the Achilles tendon and calf muscles and can also be used as a treading health instrument. The instrument includes a support base, a flat treading base hinged at one end of the support base, an angle adjusting member, and a semi-cylindrical member formed to the arches of human feet. The Achilles tendon and calves are stretched by placing the feet flat on the inclined treading base.

In addition to the various exercising devices described above, there are devices that may appear superficially similar in shape to the present invention, but function in a completely different manner. McCafferty et al., U.S. Pat. No. 3,401,931, discloses an adjustable starting block. The device comprises an open-ended channel base member, a first panel hinged to the base and hinged to a second panel which props up the first panel. When not in use, the panels lie flat against the base member for storage. The starting block is used by securing the base member to the ground, and propping up the first panel. A runner places his heel on the surface of the first panel and uses that surface to push away from when he propels himself forward.

Fichter et al., U.S. Pat. No. 3,746,335, discloses a track mounted rail and adjustable starting block. The rail has upwardly open, forwardly inclined slits spaced longitudinally in the direction of travel. The block is designed to be selectively mounted in the slits on opposite sides of the rail.

None of the prior art patents address the problems associated with plantar fasciitis or provide solutions to prevent or facilitate the rehabilitation of the condition. The prior art related to exercise and stretching equipment discloses various devices that position the foot in a single plane. The prior art relating to starting blocks is designed to elevate the heel of the foot.

Thus, there exists a need for a stretching device designed to simultaneously stretch the Achilles tendon cord, arch of the foot and the calf muscles. There exists a further need for a stretching device designed to rehabilitate plantar fasciitis.

SUMMARY OF THE INVENTION

The present invention provides a stretching device designed to simultaneously stretch the Achilles tendon cord, arch of the foot and calf muscles by inclining the toes upward against a first surface, thereby placing the arch of the foot in tension and keeping the heel and ball of the foot flat against a second surface.

Stated in somewhat greater detail, the stretching device comprises a foot supporting member having an upper surface for receiving the heel and ball of the foot, and a selectively positionable upper member angularly adjustable upwardly from the foot supporting member. The upper member supports the user's toes in an inclined position relative to the ball and heel, so that the calf muscles, Achilles tendons, and arch of the foot simultaneously are stretched as the user leans forwardly.

Thus, it is an object of the present invention to provide a new and improved foot and leg stretching device.

It is a further object of the present invention to provide a foot and leg stretching device whereby the Achilles tendon cord, arch of the foot and calf muscles are stretched simultaneously.

It is a further object of the present invention to provide a foot and leg stretching device designed to prevent the user from experiencing a tightening of the Achilles tendon cord.

It is a further object of the present invention to provide a foot and leg stretching device designed to prevent the user from experiencing a tightening of the calf muscles.

It is a further object of the present invention to provide a foot and leg stretching device designed to prevent the user from experiencing a tightening of the arch of the foot or plantar fascia.

It is a further object of the present invention to provide a foot and leg stretching device that rehabilitates the user's plantar fascia after the user has developed the condition of plantar fasciitis.

It is a further object of the present invention to provide a method of stretching the human foot and leg whereby the Achilles tendon cord, arch of the foot and calf muscles are stretched simultaneously.

Other objects, features and advantages of the present invention will become apparent upon reading the following detailed description of the embodiments of the invention, when taken in conjunction with the drawings and appended claims.

BRIEF DESCRIPTION OF THE DRAWINGS

The invention will now be described with reference to the accompanying drawing, which illustrates a preferred embodiment of the foot and leg stretching device and method, falling within the scope of the appended claims, and in which:

DETAILED DESCRIPTION OF THE DRAWINGS

Figure 1:
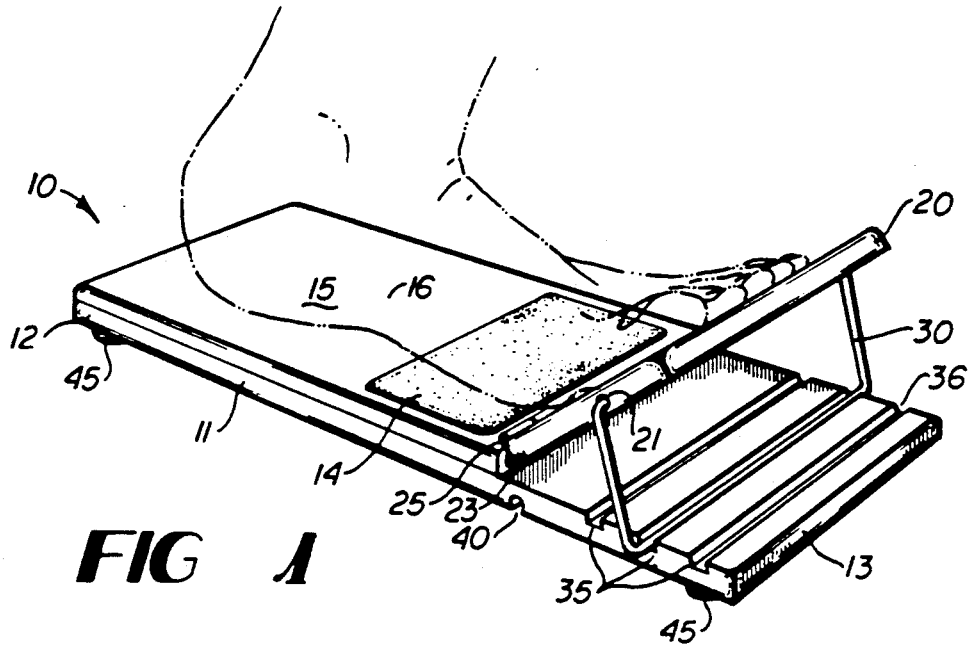
FIG. 1 is a perspective view showing a preferred embodiment of the foot and leg stretching device in use.

Referring now in more detail to FIG. 1, the device is shown generally at 10 in a functional position with a toe plate 20 in an inclined position. The device includes a generally rectangular flat base plate 11 whose length and breadth approximately include the overall outline area of the human foot, a foot plate 15 mounted on the top surface of the base plate, a toe plate 20, and a support arm 30. The base plate 11 has a heel end 12 and a toe end 13. The foot plate 15 is secured to the upper surface of the heel end 12 of the base plate 11 and extends longitudinally along the base plate for a distance approximately equal to the heel-to-ball length of a foot, which in the disclosed embodiment is about ⅔ the length of the base plate. The toe plate 20 is located above the toe end 13 of the base plate 11. The toe plate 20 is attached to the foot plate 15 by means of a hinge 25. The hinge 25 is preferably continuous and has leaves attached to the abutting vertical ends of the foot plate 15 and the toe plate 20.

A pad 14 is secured to the upper surface 16 of the foot plate 15. The pad 14 is made of material having a substantial coefficient of friction that inhibits the ball of the foot from slipping when in use.

Figure 2:
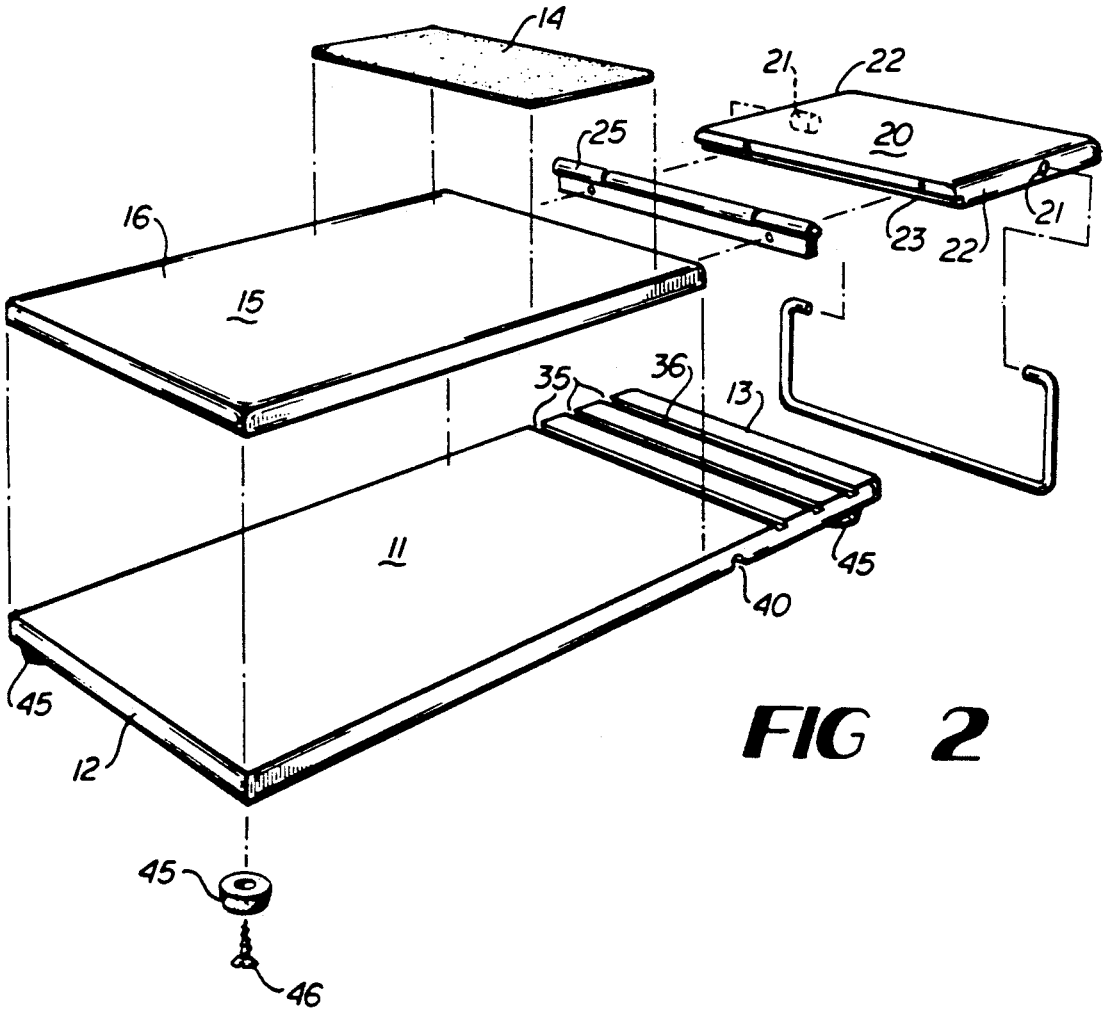
FIG. 2 is an exploded view of the preferred embodiment.
Figure 3:
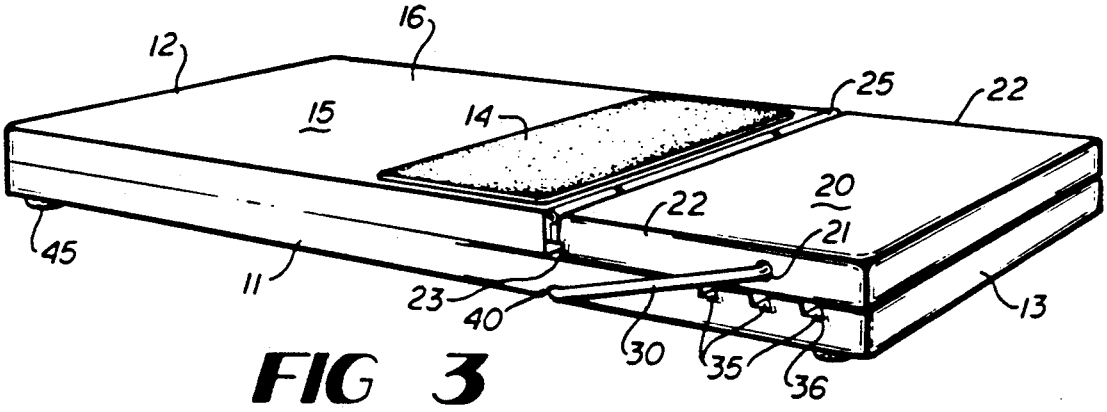
FIG. 3 is a pictorial view of the disclosed embodiment in its storage position.

A wire support arm 30 is attached to the sides of the toe plate 20. The support arm 30 is a generally C-shaped rod having two mutually-opposed ends pivotally received in openings 21 formed in the opposite longitudinal sides 22 of the toe plate 20, so that the support arm can pivot freely about the toe plate 20. Along the upper surface of the toe end 13 of the base plate 11 is a series of parallel, transverse notches 35. The notches 35 receive the support arm 30 when the toe plate 20 is in an inclined position. The notches 35 are designed to correspond to different adjustable levels of inclination of the toe plate 20. For example, a first notch 36 may be designed to correspond to a 30° incline. A toe plate notch 23 is located on the lower surface of the toe plate adjacent to the hinge 25, as shown in FIGS. 1-3. The notch 23 receives the support arm 30 when the toe plate 20 is in a horizontal position.

Figure 4:
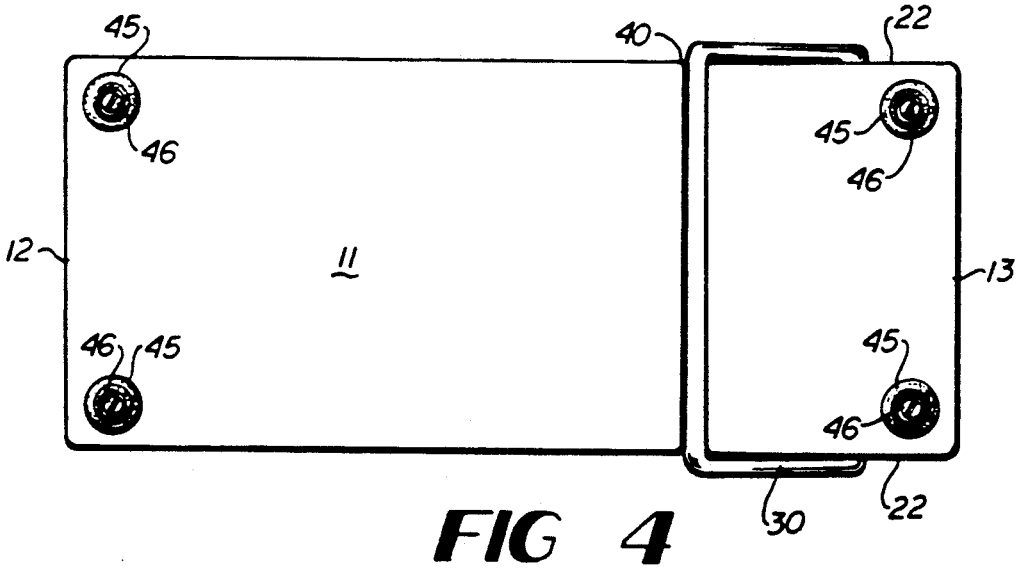
FIG. 4 is a bottom view of the disclosed embodiment in storage position.

On the lower surface of the base plate 11 is a single transverse storage notch 40 designed for use when the device is being stored, as shown in FIGS. 3 and 4. The storage notch 40 receives the support arm in a position that keeps the lower surface of the toe plate 20 parallel to the base plate.

Also on the lower surface of the base plate 11 are support feet 45 secured to the base plate by means of screws 46. The support feet 45 are designed to keep the base plate 11 from moving while in use.

In operation, the support arm 30 is removed from its position within the storage notch 40 to one of the upper notches 35. The exact selection will depend on the desired level of inclination. The toes of a human foot then are placed on the inclined toe plate 20 while the heel and ball of the foot remain flat on the foot plate 15. The friction pad 14 provides a firm gripping surface for the ball of the foot, in this position. When the toes are on the toe plate 20 in an inclined position, the arch of the foot is in tension. While the toes are in an inclined position on the toe plate 20, the user leans forward to stretch the calf muscles, Achilles tendon cord and arch of the foot simultaneously.

It will be appreciated that the embodiment discussed above is the preferred embodiment, and that various alternative embodiments are contemplated, falling within the scope of the appended claims. For example, the toe plate can be supported in an inclined position by something other than a wire arm and series of parallel notches. Furthermore, positional adjectives such as lower and upper are used only to provide an understanding of the interrelationship of the various parts of the invention. Other orientations of the invention are contemplated.

I claim:

1. A foot and leg stretching device comprising:

a base plate having an upper and lower surface, and a series of grooves located across the width of the upper surface of the base plate, said base plate having a size suitable to receive a human foot;

a foot plate secured to the upper surface of the base plate suitably sized to receive and support the heel and ball of a human foot;

an adjustable toe plate suitably sized to receive the toe of the human foot, the adjustable toe plate hingedly connected to the foot plate to assume an inclined angle with respect to the foot plate; and a support arm pivotably attached to the toe plate to engage a selected one of the grooves and thereby support the toe plate at the inclined angle.

2. The device of claim 1 wherein said base plate contains a linear groove in the lower surface to receive the support arm when the toe plate is parallel to the foot plate.

3. The device of claim 1 wherein the toe plate contains a linear notch to receive the support arm and the groove is located across the lower surface of the toe plate adjacent to the foot plate.

4. A foot and leg stretching device comprising:

a stationary foot supporting means having an upper surface suitably sized to receive and support the heel, arch and ball of a human foot, and a series of retaining members located along the width of the foot supporting means;

an adjustable toe plate suitably sized to receive the toe of the human foot, the adjustable toe plate hingedly connected and in pivotable relation with the upper surface of the foot supporting means for pivoting movement relative thereto and selectively positionable at an inclined angle with respect to the upper surface of the foot supporting means; and a support member pivotably connected with respect to the toe plate and engageable with a selected one of said retaining members for retaining the toe plate at the selected inclined angle with respect to the upper surface of the foot supporting means, whereby the toe of the foot are inclined upwardly by the toe plate and the arch of the foot thus is put in tension while the heel, the arch and the ball of the foot remain flat on the upper surface of the foot supporting means.

5. The device of claim 4, wherein:

the upper surface of the foot supporting means is flat and remains substantially horizontal when the device rests on a horizontal surface, so that the heel, the arch, and the ball of the foot remain flat in one plane while the toe plate is at an inclined angle to the horizontal.

6. The device of claim 4, wherein the support member comprises an arm depending from the toe plate for engaging with a selected one of said retaining members so as to adjust the angle of incline of the toe plate with respect to the upper surface on the foot supporting means.

7. A method for stretching the Achilles tendon cord, arches of the feet, and calf muscles of an exerciser using a foot and leg stretching device, said foot and leg stretching device comprising a stationary foot supporting means having a stationary foot supporting surface secured on one end and the other end having a series of grooves located along the width of said stationary foot supporting means, a toe plate hingedly connected to said stationary foot supporting surface with a support arm pivotably attached thereto, said method comprising the steps of:

positioning the toe plate of the foot and leg stretching device in a selectively positionable inclined angle by placing the support arm in one of the series of grooves;

positioning the stationary foot supporting surface of the foot and leg stretching device in horizontal alignment with and longitudinally adjacent to the toe plate;

placing the heel and ball of the exerciser's foot onto the foot supporting means;

placing the exerciser's toes on the inclined toe plate; and altering the exerciser's position from completely vertical to a forward position creating an angle with the vertical so that the exerciser's Achilles tendon cord, arch of the foot, and calf muscles are stretched simultaneously.

* * * * *